US005530224A

United States Patent [19]

Sassman

[11] Patent Number: 5,530,224

[45] Date of Patent: Jun. 25, 1996

[54] SYSTEM AND METHOD FOR RETROFITTING COOKTOPS WITH A CERAMIC GLASS COOKING SURFACE

[76] Inventor: Mark S. Sassman, 1055 N. Capitol Ave., #12, San Jose, Calif. 95133

[21] Appl. No.: 218,224

[22] Filed: Mar. 25, 1994

[51] Int. Cl.[6] ..... H05B 3/68

[52] U.S. Cl. ..... 219/464; 219/463

[58] Field of Search ..... 403/401–402; 126/211, 217, 214 A, 214 B, 212, 39 B; 219/464–468, 463, 459

[56] References Cited

U.S. PATENT DOCUMENTS

| | | | |
|---|---|---|---|
| 2,701,396 | 2/1955 | Perkins | 403/402 |
| 3,490,123 | 1/1970 | Clark | 29/183 |
| 3,567,906 | 3/1971 | Hurko | 219/464 |
| 3,632,983 | 1/1972 | Dills | 219/464 |
| 4,243,016 | 1/1981 | Kristen | 126/211 |
| 4,360,567 | 11/1982 | Guillevic | 428/410 |
| 4,363,956 | 12/1982 | Scheidler | 219/464 |
| 4,492,217 | 1/1985 | Scheidler | 126/39 B |
| 5,036,831 | 8/1991 | Ray | 126/211 |
| 5,130,049 | 7/1992 | Sage | 252/299.63 |
| 5,179,045 | 1/1993 | Altken et al. | 501/4 |

*Primary Examiner*—Teresa J. Walberg
*Assistant Examiner*—Sam Paik
*Attorney, Agent, or Firm*—Baker & Daniels

[57] ABSTRACT

A stain-resistant, easy to clean member, having a substantially planar surface, is removably attached to frame that is previously removably installed on an electric cooktop. The member has thermal transfer characteristics such that heat is transferred from underlying heating elements to substantially superjacent portions of the surface, with little lateral transfer of thermal energy. Thermochroic material is incorporated on the visible top surface to provide an indication of the surface heat distribution.

20 Claims, 4 Drawing Sheets

SYSTEM AND METHOD FOR RETROFITTING COOKTOPS WITH A CERAMIC GLASS COOKING SURFACE

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever.

BACKGROUND OF THE INVENTION

1. Field of the Invention

The present invention relates generally to ceramic glass cooking surfaces, and more particularly to a system and method of retrofitting existing cooktops and free-standing stoves with a ceramic glass cooking surface.

2. Related Art

Indoor cooking apparatus have evolved over the years from the open hearth, to wood or coal burning stoves, to more modern natural gas and electric cooktops and free-standing stoves. Microwave ovens, have also become popular for cooking.

While virtually all homes are supplied with electricity, there are many that are not supplied with natural gas. Even in homes that are supplied with natural gas, this fuel is often used only for space and water heating, rather than for cooking. Electric kitchen appliances such as free-standing stoves, cooktops and ovens can be installed and used in residential and non-residential settings alike, without the danger of gas leaks. The almost universal availability and convenience of electric power has resulted in the widespread use of electric cooktops. FIG. 1 shows a top view of a typical, well-known, electrical cooking apparatus.

Preparation of food at elevated temperatures, such as by frying or simmering, often transfers sufficient kinetic energy to small amounts of the food being prepared that these energetic portions are ejected from the pots or pans and fall onto the cooktop surface. When these food particles land on a burner element they can become "baked-on" and thus difficult to clean. When these food particles land in the well which is formed underneath the burner element, cleaning is again difficult as the burner element itself must be removed to gain access to soiled well region. 0f course, cleaning of the well must wait until the burner element has cooled sufficiently to be safely removed.

A conventional approach to this problem is a ceramic glass cooktop that is built-in as a unit in a new stove, or that is installed in a remodeled kitchen after the pre-existing cooktop has been removed. This type of surface is referred to as a "smoothtop" and is formed from a ceramic glass. Typically this ceramic glass is a commercially available material known as CERAN and manufactured by Schott Glaswerke, Hattenbergstrasse 10, Mainz, Germany. Three types of smoothtop, all of the built-in variety, are known today (see FIG. 2). These are the radiant smoothtop, the halogen smoothtop, and the magnetic-induction smoothtop.

However, it would be advantageous to have an easy to clean, cooking surface installed without having to remove the pre-existing cooktop. In other words, it would be advantageous to have a retrofit kit for an easy to clean cooking surface installation on an existing stove top.

What is needed is a method and apparatus for retrofitting existing cooktops with easy to clean surfaces.

SUMMARY OF THE INVENTION

Accordingly, it is an object of the present invention to provide an easy to clean surface, suitable for retrofitting to existing cooktops, as an accessory for existing cooktops and free standing stove units.

Briefly, an apparatus having frame members for forming a frame, and at least one smooth-surfaced panel of heat transmissive material, is assembled on-site, to provide an easy to clean surface. In a typical embodiment of the present invention, two symmetrical, rectangular-C shaped frame members form an exterior frame assembly, and four I-beam shaped interior frame members form an interior frame assembly.

The rectangular-C shaped members have a longitudinal groove formed on their interior facing surfaces. This groove is typically fitted with a silicone seal which is attached by means of an adhesive. The rectangular-C shaped members also include a portion subjacent the groove that forms the base of the exterior frame, and this portion is referred to as the heat trap. The rectangular-C shaped members further include a portion superjacent the groove that acts as a spill guard.

The I-beam shaped interior frame members have one mitered end and one flat end. The flat ends meet the exterior frame members and the mitered ends meet each other in the center of the interior frame assembly. A consequence of the I-beam shape is the presence of two opposite facing, longitudinal, rectangular-C shaped grooves along the length of the interior frame members. The I-beam shaped interior frame members include a conformal silicone seal formed in their opposite facing grooves.

To assemble the system of the present invention, a portion of the exterior frame is first established on the cooktop. Ceramic glass panels are installed in that portion of the exterior frame, interior frame members are then installed, further ceramic glass panels may then be inserted into the grooves of the interior and exterior frame members. The final portion of the exterior frame is then established in such a manner that any exposed edges of the ceramic glass panels are fitted into the groove of the final portion of the exterior frame. The exterior frame members are then joined to each other so as to structurally integrate them as a single piece.

Other objects and advantages together with a fuller understanding of the invention will become apparent and appreciated by referring to the following description and claims taken in conjunction with the accompanying drawings.

BRIEF DESCRIPTION OF THE DRAWINGS

FIG. 8 is an expanded top view showing the relationship of the ceramic glass panels to the interior frame members.

FIG. 9 shows the rounded corners of the ceramic glass panels.

DETAILED DESCRIPTION OF THE INVENTION

Figure 1:
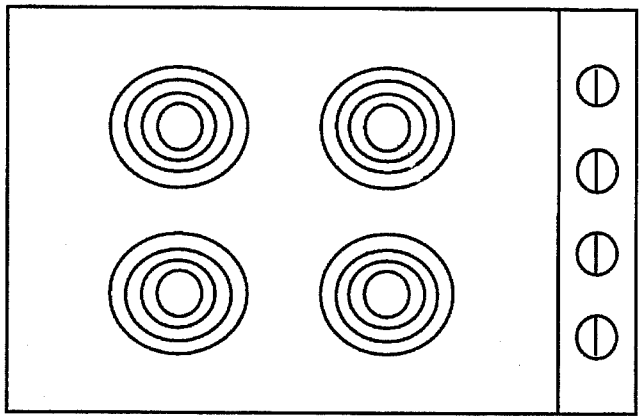
Prior Art Figure 1
FIG. 1 is a top view of a conventional four-burner electric cooktop.
Figure 2:
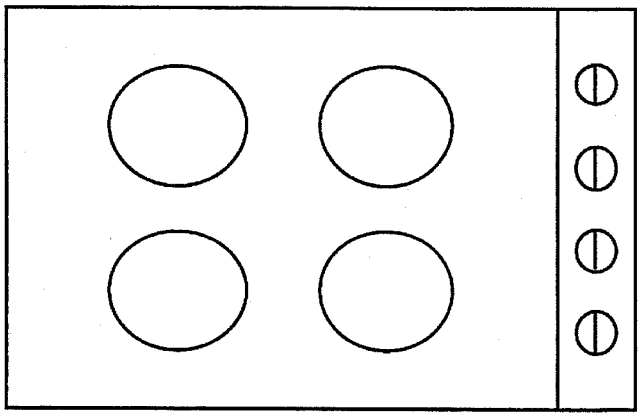
Prior Art Figure 2
FIG. 2 shows a conventional ceramic glass cooktop.

Cooktop, range, and stove, are used herein generally interchangeably to refer to apparatus containing thermal energy sources typically used in food preparation.

Heating element, burner, burner element and thermal energy source, are used herein generally interchangeably. These terms refer to the heat producing portion of a cooktop, range or stove. Although burner and heating element may be used respectively to describe gas and electric powered thermal energy sources, the term burner or burner element is used throughout this description as a convenient means of referring to a thermal energy source.

A stain-resistant, easy to clean member, having a substantially planar surface, is removably attached to a previously installed cooktop or free-standing stove unit by means of a frame assembly. The member has thermal transfer characteristics such that heat is transferred from subjacent heating elements to substantially superjacent portions of the surface, with little lateral transfer of thermal energy. Thermochroic material is incorporated on the visible top surface to provide an indication of the surface heat distribution. The frame assembly includes heat trap and spill guard portions. Although, the preferred embodiment of the present invention is directed to electrically powered cooking apparatus, the invention is not so limited and may be used with combustion powered (e.g., gas burning) cooking apparatus.

Referring to FIGS. 3–9, an embodiment of the present invention is described.

The present invention utilizes exterior and interior frame members to form a frame assembly that supports, and holds in place, one or more easy to clean panels. In a first embodiment, two symmetrical, rectangular-C shaped frame members 30 form an exterior frame assembly, and four I-beam shaped interior frame members 44 form an interior frame assembly. Frame members 30 and 44 may be made from various materials, such as wood and metal.

The outer frame members 30 typically have a groove 52 formed longitudinally on their inner (i.e., interior facing) surfaces. In this way the panels 42 are held in place after insertion therein. The relationship of the groove 52 dimensions to the dimensions of the panels 42 is such that there is adequate space for thermally induced expansion of the panels 42 during cooking. This spacing relationship is true even though the groove 52 is typically fitted with a conformal layer of silicone seal 54 which is attached by means of an adhesive. This adhesive could be a glue or some other means of attachment. The rectangular-C shaped outer frame members 30 also include a portion subjacent the groove that forms the base of the exterior frame, and this portion is referred to as the heat trap 56. The rectangular-C shaped outer frame members further include a portion superjacent the groove that acts as a spill guard 58.

The I-beam shaped interior frame members 44 have one mitered end 62 and one flat end 64. The flat ends meet the exterior frame members and the mitered ends meet each other in the center of the interior frame assembly. A consequence of the I-beam shape is the presence of two opposite facing, longitudinal, rectangular-C shaped grooves along the length of the interior frame members. The I-beam shaped interior frame members 44 include a conformal silicone seal 72 formed in their opposite facing grooves.

The cooking surface of the panels 42 is not limited to any particular topology, however, it is contemplated that a substantially planar form would be the easiest to fabricate and most convenient for the end user. However, the invention is not limited to planar panels, and crowned, convex, concave, channeled, or other topology surfaces could be used to, for example, direct spilled liquids.

FIG. 9 shows panels 42 having rounded corners to enhance handling safety.

Figure 4:
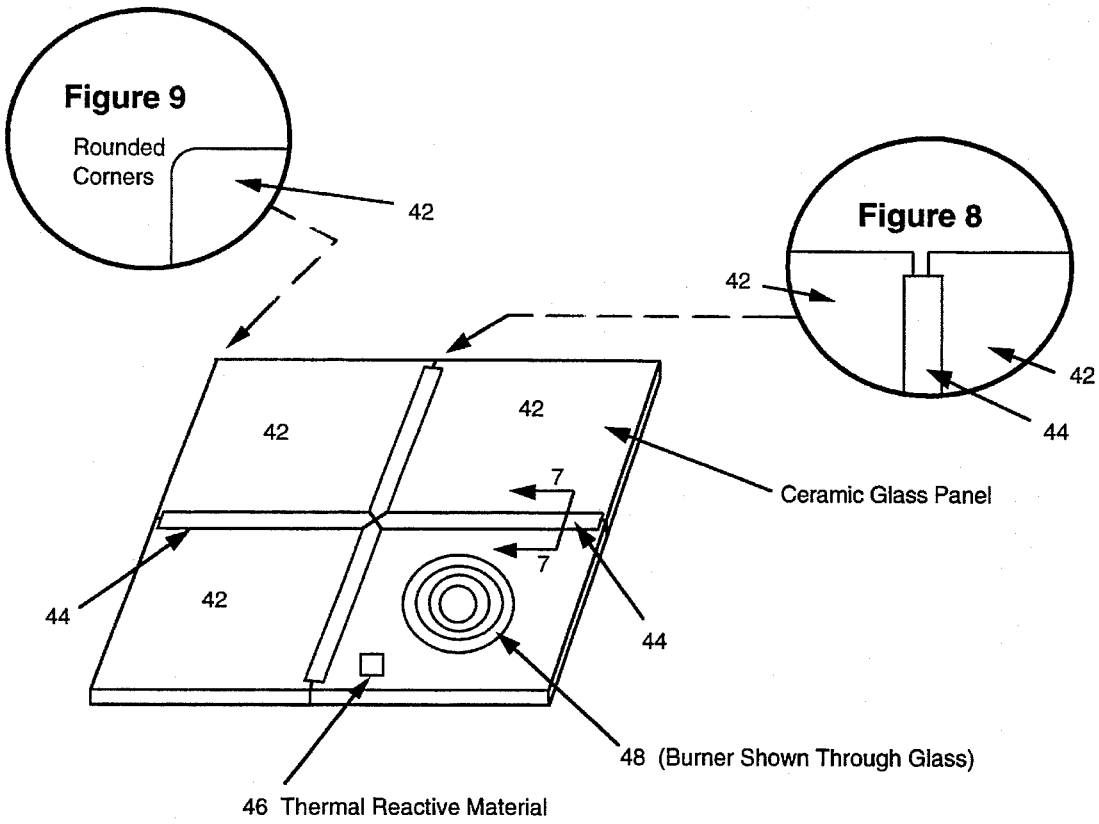
FIG. 4 shows the interior frame members as they appear after assembly together with ceramic glass panels inserted into the grooves of the interior frame members, and a temperature-indicating display.
Figure 6:
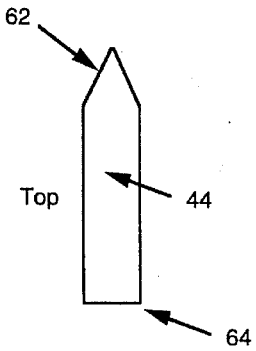
FIG. 6 is a top view of an interior frame member.
Figure 7:
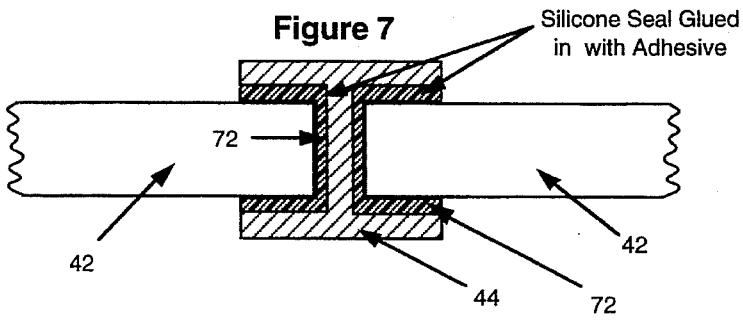
FIG. 7 is a is a cross-sectional view of an interior frame member.

The frame portion of the frame and panel assembly simply rests upon the cooktop with the panels 42 resting upon the burner elements 48, one of which is shown through the panel 42 in FIG. 4. Alternatively, the panels 42 may be in close proximity to the burner elements without actually being in contact with them. This is possible because the frame is designed to support the entire weight of the panels.

Adhesives are not required for attaching the panels 42 to the supporting frame. Further, adhesives are not required to keep the frame assembly attached to the underlying cooktop. Likewise, caulking is not used between the panels 42 and the frame members 30, 44 because the panels 42 are designed to be removed for cleaning.

Figure 3:
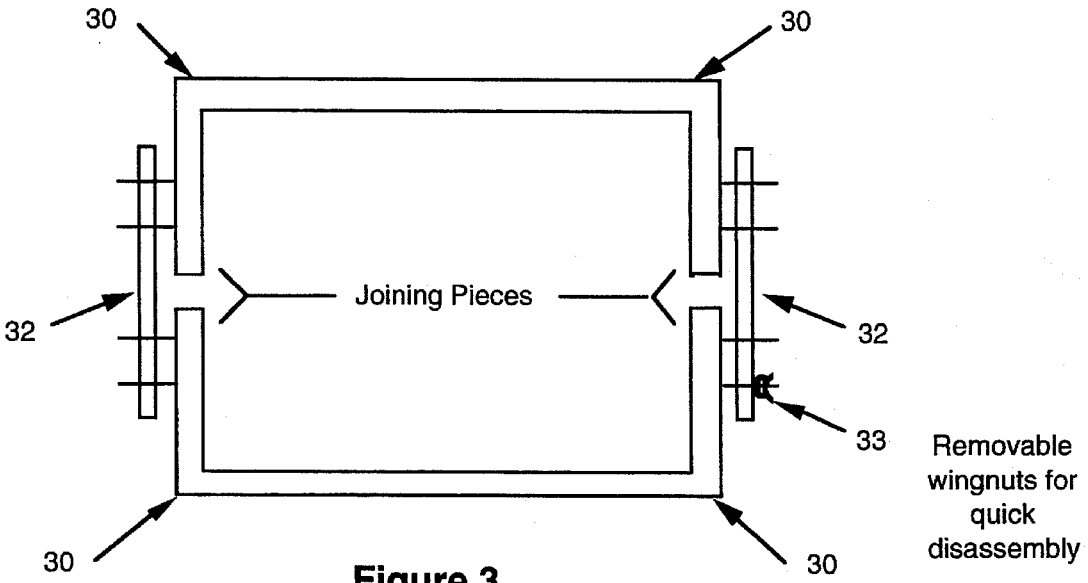
FIG. 3 shows the exterior frame members of the frame assembly.
Figure 5:
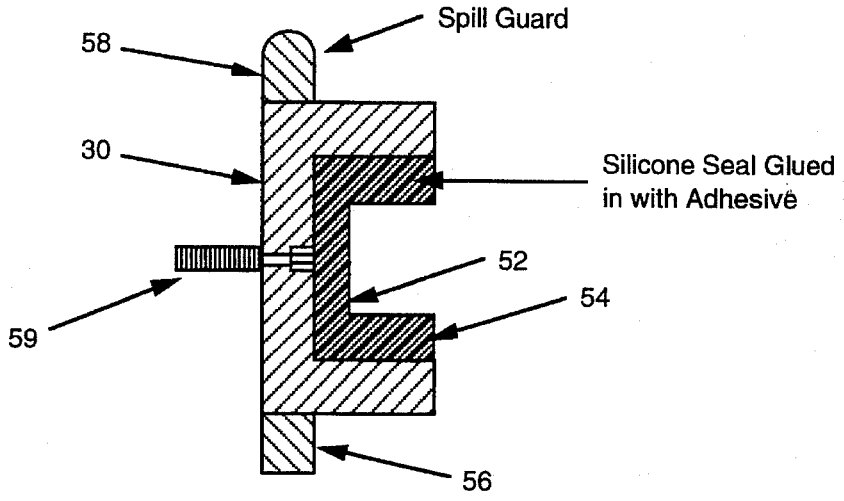
FIG. 5 is a cross-sectional view of an exterior frame member.

To assemble the system of the present invention, a first exterior frame member 30 is established on a cooktop. Ceramic glass panels 42 are installed in that first exterior frame member 30, a first interior frame member 44 is then installed, between panels 42, such that interior frame member 44 is between panels 42, with panels 42 inserted into the grooves of the I-beam. The interior frame member has its mitered end 62 directed toward the center of the frame assembly, and its flat end 64 directed toward the exterior frame member. Additional interior frame members are installed orthogonal to the first installed interior frame member, with their flat ends toward the exterior frame and their mitered ends toward the center. Further ceramic glass panels 42 may then be inserted into the grooves of the interior and exterior frame members. The final portion of the exterior frame is then established in such a manner that any exposed edges of the ceramic glass panels are fitted into the groove of the final portion of the exterior frame. The exterior frame members are then joined to each other so as to structurally integrate them as a single piece. FIG. 3 shows joining pieces 32 used to secure two rectangular-C shaped outer frame members together via removable wingnuts 33 for quick disassembly. FIG. 5 shows a cross-section of the outer frame member 30, wherein a securing means such as bolt 59, is used in conjunction with joining piece 32 to secure the outer frame members together.

Figure 10:
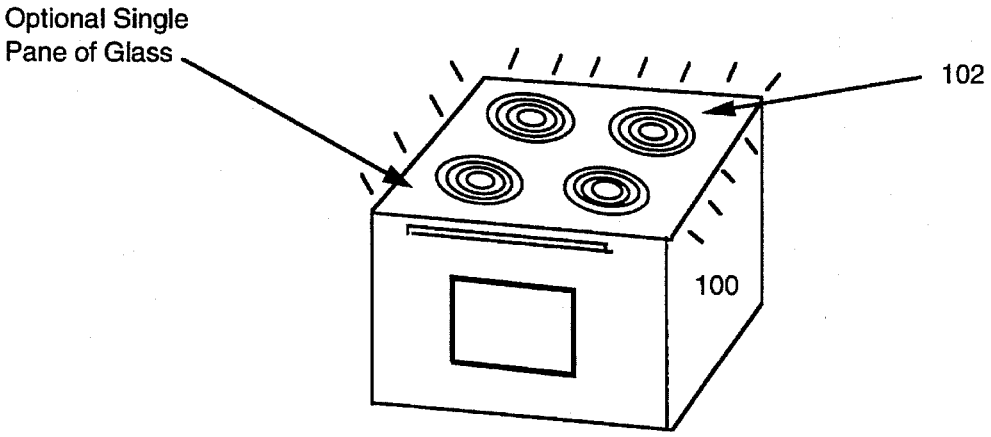
FIG. 10 shows an alternative embodiment of the present invention wherein a single piece of heat transmissive, easy to clean material is mounted on a stove without the use of a frame assembly.

FIG. 10 shows the present invention in its simplest form. A single pane of ceramic glass 102 is mounted on top of a cooking apparatus 100.

In a second embodiment of the present invention, thermochroic material 46 is applied to the surface of the panels 42, typically in a position toward the peripheral edges of the panels 42 so that the thermochroic material 46 is not directly over a burner element 48. This positioning is chosen because constant placement and removal of pots and pans on the panel 42 in the neighborhood of the underlying burner element 48 would tend to cause excessive wear of the thermochroic material 46.

Thermochroic or thermal reactive materials 46 respond to thermal variation by changing their optical characteristics. Some of these material change color, others change from opaque to light transmissive. Thermochroic material 46 is incorporated on the visible top surface to provide an indication of the surface heat distribution.

Figure 11:
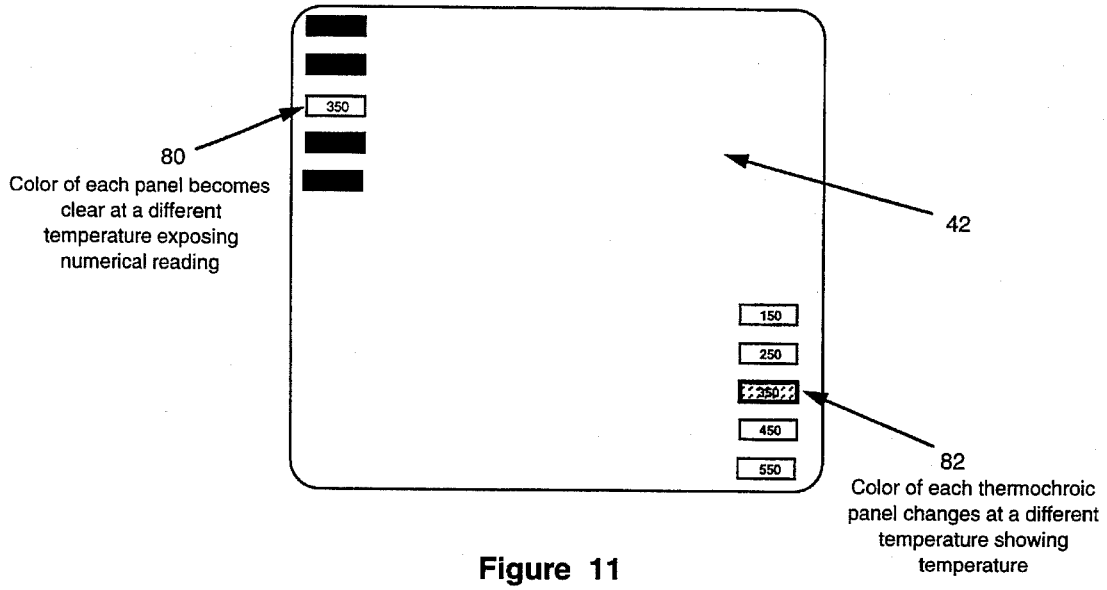
FIG. 11 shows an exemplary thermochroic display pattern.

A visible temperature indicator can be built-in to the panels by using a normally opaque thermochroic material 46 that becomes light transmissive within some temperature range that overlaps the temperatures encountered on the cooking surface panels 42, wherein that material covers a temperature display such that portions of the temperature display become visible as the temperature of the glass panel 42 rises above the opaque to transmissive transition temperature. The actual layout of the temperature display/thermochroic material combination can be quite varied. Typically, a substantially straight line emanating from the region of a panel 42 that overlies a burner element 48, heading in the direction of the panel periphery is used. However, FIG. 11 shows another possible configuration wherein a series of rectangles are used. Rather than the thermochroic material becoming clear as shown at 80 and as described above, as shown at 82 the color of each thermochroic panel can change at different temperatures to show a panel temperature.

Referring to

Figure 12:
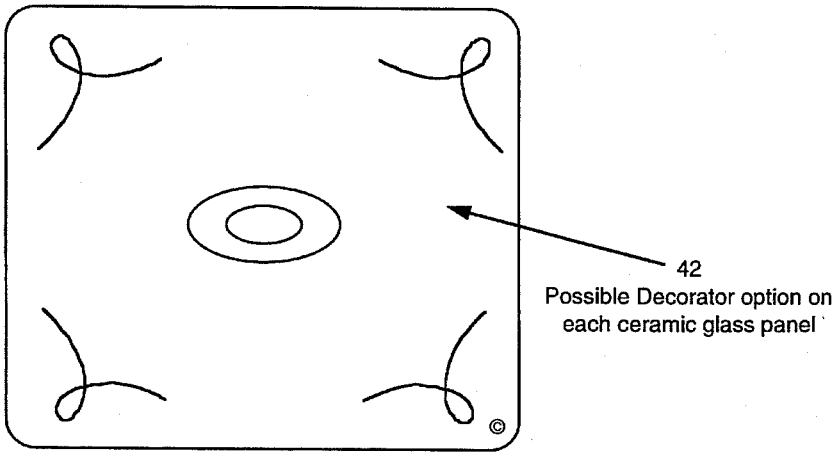
FIG. 12 shows exemplary decorative options possible to assemble with the system and method of the present invention.

FIG. 12, a third embodiment of the present invention is shown wherein, panels having different and/or coordinated decorative designs can be used. Decorative panels can be changed to create new designs, or appearances for the cooking surface. This allows cooking surface to help create a number of different ambiances. For example, a Thanksgiving-type pattern, a Christmas-type pattern, or a Fourth of July-type pattern etc., can be used. Additionally, various other design schemes such as landscapes, color combinations, or geometric patterns can be used.

While the invention has been described in conjunction with several specific embodiments, it is evident to those skilled in the art that many further alternatives, modifications and variations will be apparent in light of the foregoing description. For example, the smoothtop cooking surface may have some texturing or patterning. Thus the invention described herein is intended to embrace all such alternatives, modifications, applications and variations as may fall within the scope of the subjoined claims.

What is claimed is:

1. An apparatus for retrofitting an electric cooktop with a cooking surface, said cooking surface adapted to disassemble for cleaning, comprising:

a) a plurality of cooking surface panels;

b) a first rectangular-C shaped outer frame member having an exterior facing surface and an interior facing surface, said interior facing surface having a longitudinal groove formed therein;

c) a second rectangular-C shaped outer frame member having an exterior facing surface and an interior facing surface, said interior facing surface having a longitudinal groove formed therein;

d) a plurality of I-beam shaped interior frame members, each of said interior frame members having one mitered end and one flat end, said I-beam shape providing said interior frame members with groove-like sidewalls;

e) at least two joining pieces; and f) a first plurality of securing means for mounting and holding said joining pieces, said first plurality of securing means located on said exterior surface of said first rectangular-C shaped outer frame member, and a second plurality of securing means for mounting and holding said joining pieces located on said exterior surface of said second rectangular-C shaped outer frame member;

wherein said plurality of I-beam shaped interior frame members, form an interior frame assembly disposed within an outer frame assembly formed by said first and said second rectangular-C shaped outer frame members, said cooking surface panels are disposed between said inner and said outer frame assemblies, and said joining pieces are removably attached to said outer frame assembly.

2. The apparatus of claim 1, further comprising a first heat trap member disposed subjacent said first rectangular-C shaped outer frame member, and a second heat trap member disposed subjacent said second rectangular-C shaped outer frame member.

3. The apparatus of claim 1, further comprising a first spill guard member disposed superjacent said first rectangular-C shaped outer frame member, and a second spill guard member disposed superjacent said second rectangular-C shaped outer frame member.

4. The apparatus of claim 1, wherein said first and second rectangular-C shaped outer frame members comprise wood.

5. The apparatus of claim 1, wherein said first and second rectangular-C shaped outer frame members comprise metal.

6. The apparatus of claim 1, wherein said cooking surface elements comprise ceramic glass.

7. The apparatus of claim 1, wherein said cooking surface panels comprise ceramic glass, said ceramic glass having a pattern of thermochroic material disposed thereon such that said thermochroic pattern is visible to an observer.

8. The apparatus of claim 1, wherein said longitudinal grooves formed on said interior facing surfaces of said first and said second rectangular-shaped C exterior frame members have a conformal layer of silicone sealer formed within said grooves.

9. The apparatus of claim 1, wherein said groove-like sidewalls of each of said I-beam shaped interior frame members have a conformal layer of silicone sealer formed within said groove-like sidewalls.

10. The apparatus of claim 8, wherein said conformal layer of silicone sealer formed within said groove-like sidewalls is attached to said sidewalls with an adhesive material.

11. The apparatus of claim 9, wherein said conformal layer of silicone sealer formed within said groove-like sidewalls is attached to said sidewalls with an adhesive material.

12. The apparatus of claim 11, wherein said adhesive material is glue.

13. An easy-to-clean, non-stick cooking surface and supporting assembly, comprising:

a) a first plurality of frame members detachably connected so as to form a substantially rectangular frame;

b) a second plurality of frame members cooperatively arrangeable with said rectangular frame to form a supporting assembly, wherein said second plurality of frame members comprise longitudinal, panel receiving grooves defined by upper and lower flanges adapted to overlay top and bottom panel surfaces respectively; and c) a plurality of cooking surface panels inserted into, and supported by said supporting assembly, wherein said panels are disposed within said grooves when inserted into said supporting assembly;

wherein said panels are removable from said supporting assembly by means of detaching at least one of said first frame members from said supporting assembly.

14. The apparatus of claim 13, wherein said first and second plurality of frame members comprise wood.

15. The apparatus of claim 13, wherein said first and second plurality of frame members comprise metal.

16. The apparatus of claim 13, wherein said cooking surface panels comprise ceramic glass.

17. The apparatus of claim 13, wherein said cooking surface elements comprise ceramic glass, said ceramic glass having a pattern of thermochroic material disposed thereon so that said thermochroic pattern is visible to an operator.

18. A method of retrofitting an installed cooktop with a non-stick cooking surface, said method comprising the steps of:

a) providing said installed cooktop, said cooktop having at least one burner element;

b) assembling a substantially rectangular outer frame from a first plurality of frame members, said outer frame having an interior area substantially equal to the area of said cooktop, and each of said first plurality of frame members having a longitudinally-oriented groove formed on an interior facing side, wherein said groove is defined by upper and lower frame portions adapted to overlay top and bottom panel surfaces respectively;

c) mounting said outer frame on said cooktop; and d) inserting at least one panel into said outer frame to form said cooking surface, wherein during said inserting said at least one panel is inserted into said grooves of said first plurality of frame members.

19. The method of claim 18 wherein step (c) further comprises the step of removably attaching joining pieces to said outer frame members.

20. The method of claim 18 further comprising the step of providing an interior frame which forms a support structure with said outer frame, wherein said interior frame comprises panel receiving grooves, wherein said at least one panel comprises a plurality of panels, and wherein said step of inserting comprises fitting said plurality of panels into said panel receiving grooves of said interior frame.

* * * * *

UNITED STATES PATENT AND TRADEMARK OFFICE

CERTIFICATE OF CORRECTION

PATENT NO. : 5,530,224
DATED : June 25, 1996
INVENTOR(S) : Mark S. Sassman

It is certified that error appears in the above-indentified patent and that said Letters Patent is hereby corrected as shown below:

Title page, Item [76] (Inventor), delete "1055 N. Capitol Ave., #12, San Jose, Calif. 95133", as address of inventor, and insert --5865 Wildflower Drive, Indianapolis, IN 46254--.

In Claim 1, column 5, lines 50-51, delete "An apparatus for retrofitting an electric cooktop with a cooking surface", and insert --A retrofitting cooking surface apparatus for an already installed cooktop--.

In Claim 1, column 5, line 51, after "said", delete "cooking surface", and insert --apparatus--.

In Claim 13, column 6, line 55, delete "An" and insert --A retrofitting--.

In Claim 13, column 6, line 55, after "surface", delete "and supporting

UNITED STATES PATENT AND TRADEMARK OFFICE

CERTIFICATE OF CORRECTION

PATENT NO. : 5,530,224

DATED : June 25, 1996

INVENTOR(S) : Mark S. Sassman

It is certified that error appears in the above-indentified patent and that said Letters Patent is hereby corrected as shown below:

assembly", and insert --apparatus for an already installed cooktop--.

Signed and Sealed this

Twenty-ninth Day of October 1996

*Attest:*

Bruce Lehman

BRUCE LEHMAN

*Attesting Officer*

*Commissioner of Patents and Trademarks*